United States Patent [19]

Graham

[11] Patent Number: 5,076,488

[45] Date of Patent: Dec. 31, 1991

[54] SILICON GRAIN REFINEMENT OF ZIRCONIUM

[75] Inventor: Ronald A. Graham, Salem, Oreg.

[73] Assignee: Teledyne Industries, Inc., Albany, Oreg.

[21] Appl. No.: 409,081

[22] Filed: Sep. 19, 1989

[51] Int. Cl.[5] ..... B21D 39/04

[52] U.S. Cl. ..... 228/131; 376/416; 376/417; 376/414; 148/11.5 Q; 420/423; 264/0.5; 264/515; 72/258; 228/155; 228/231

[58] Field of Search ..... 376/416, 417, 414; 148/11.5 Q, 127; 420/422, 423; 72/253.1, 258; 264/0.5, 515; 228/131, 231, 155

[56] References Cited

U.S. PATENT DOCUMENTS

| | | | |
|---|---|---|---|
| 4,108,687 | 8/1978 | Armand et al. | 148/2 |
| 4,200,492 | 4/1980 | Armijo et al. | 76/82 |
| 4,372,817 | 2/1983 | Armijo et al. | 376/417 |
| 4,390,497 | 6/1983 | Rosenbaum et al. | 376/414 |
| 4,610,842 | 9/1986 | Vannesjo | 376/416 |
| 4,718,949 | 1/1988 | Takase et al. | 148/11.5 |
| 4,783,311 | 9/1988 | Ferrari | 376/417 |
| 4,810,461 | 3/1989 | Inagaki et al. | 376/457 |
| 4,894,203 | 1/1990 | Adamson | 376/416 |
| 4,942,016 | 7/1990 | Marlowe et al. | 376/418 |

*Primary Examiner*—Robert L. Stoll
*Assistant Examiner*—Nina Bhat
*Attorney, Agent, or Firm*—Shoemaker and Mattare

[57] ABSTRACT

The present invention relates to the control of grain structure in unalloyed zirconium metal and, more particularly, to the control of grain structure in zirconium metals containing less than 300 parts per million Fe.

2 Claims, 2 Drawing Sheets

| | TEMP | 215 ppm Fe | 310ppm Fe | 425ppm Fe | 710ppm Fe | 1240ppm Fe | 92 ppm Si |
|---|---|---|---|---|---|---|---|
| 1 | 500.000 | 10.100 | 8.500 | 8.300 | 7.400 | 6.800 | 6.300 |
| 2 | 550.000 | 13.300 | 11.500 | 9.300 | 8.300 | 7.200 | 6.700 |
| 3 | 600.000 | 15.900 | 13.600 | 10.100 | 8.800 | 7.400 | 7.400 |
| 4 | 625.000 | 17.100 | 15.900 | 11.100 | 9.800 | 8.300 | 7.800 |
| 5 | 650.000 | 21.500 | 19.000 | 14.700 | 10.900 | 9.500 | 9.800 |
| 6 | 700.000 | 36.400 | 27.800 | 24.100 | 20.800 | 15.900 | 11.100 |

Fe ADDITIONS GS VS. TEMP.

| | TEMP | 215 ppm Fe | 310 ppm Fe | 425 ppm Fe | 710 ppm Fe | 1240 ppm Fe | 92 ppm Si |
|---|---|---|---|---|---|---|---|
| 1 | 500.000 | 10.100 | 8.500 | 8.300 | 7.400 | 6.800 | 6.300 |
| 2 | 550.000 | 13.300 | 11.500 | 9.300 | 8.300 | 7.200 | 6.700 |
| 3 | 600.000 | 15.900 | 13.600 | 10.100 | 8.800 | 7.400 | 7.400 |
| 4 | 625.000 | 17.100 | 15.900 | 11.100 | 9.800 | 8.300 | 7.800 |
| 5 | 650.000 | 21.500 | 19.000 | 14.700 | 10.900 | 9.500 | 9.800 |
| 6 | 700.000 | 36.400 | 27.800 | 24.100 | 20.800 | 15.900 | 11.100 |

Fe ADDITIONS GS VS. TEMP.

| | Si ppm | BQ GRAIN SIZE | GRAIN SIZE |
|---|---|---|---|
| 1 | 13.000 | 20.800 | 18.500 |
| 2 | 30.000 | 11.100 | 10.800 |
| 3 | 49.000 | 9.800 | 11.300 |
| 4 | 69.000 | 9.500 | 9.300 |
| 5 | 94.000 | 8.100 | 8.500 |

SILICON GRAIN REFINEMENT OF ZIRCONIUM

BACKGROUND OF THE INVENTION

Zirconium tubing containing an outer layer of zirconium metal alloy and an inner layer of unalloyed zirconium metal is used extensively in nuclear power reactors and, in particular, in boiling water reactors.

The tubing is used to form a cladding to contain and support nuclear fuel pellets, usually made of uranium dioxide. The purpose of the pure or unalloyed zirconium liner is to reduce or prevent local chemical or mechanical interaction, or both, between the fuel pellets during the operation of the reactor and the more susceptible and more reactive outer zirconium alloy sheath. Such interactions between the fuel pellets and the cladding material is believed to be responsible for what is termed "iodine assisted stress corrosion cracking" of the outer zirconium alloy (Zircaloy) sheath. The resultant cracking of the sheath is deleterious to the safety of the reactor operation and to the lifetime of the fuel as it permits radioactive gaseous products of the fission reactions to diffuse therethrough and escape into the reactor vessel as well as permitting water or steam to contact the fuel elements directly.

The current accepted solution to the problem of iodine assisted stress corrosion cracking of zirconium alloys is the expedient of providing the structural zirconium alloy with an internal liner of substantially pure zirconium. This relatively inert unreactive liner provides the ductility required to prevent the pellet-cladding interactions described.

The success of such liners has prompted most manufacturers to specify pure or substantially pure zirconium liners for the cladding inner tube liner. As a consequence, lower levels of oxygen and iron impurities are being tolerated. This has created a secondary problem of major concern.

As zirconium is rendered purer, the metallurgical grain size of the zirconium in the liner tends to increase. Normally impurities such as iron when present in amounts above its solubility limit in zirconium tend to pin grain boundaries in place during the thermal processing required in the manufacture of the liner if the iron is present as a finely dispersed intermetallic second phase. Moreover, as the grain size increases, secondary grain growth occurs which contributes to the formation of a non-uniform bi-modal grain size distribution where many smaller grains co-exist with many larger grains. This bi-modal or duplex distribution creates problems during the subsequent fabrication processing for making barrier tube shells into finished tubing.

Normally a zirconium alloy tube mated to an unalloyed zirconium tube are tube reduced in a Pilger mill which reduces the size of the tube to the eventual size of the combination for its cladding function. When the purity of the zirconium liner has reduce the pining function of some impurities and a bi-modal grain distribution has formed, local microcracking begins to occur at the grain boundaries between the clusters of large and small grains. It is believed that the local deformation inhomogeneities present between clusters or aggregates of large grains and aggregates or clusters of small grains, causes the zirconium to respond differently to deformation induced straining. It appears that the stresses created in the tube reducing operation can exceed the cohesive strength of the grain boundaries. The resultant microcracks, if numerous or deep enough, will significantly reduce the liners ability to prevent the local pellet-cladding interactions previously described.

It is therefore an objective of the present invention to reduce the occurrence of microcracking at grain boundaries in relatively pure zirconium fuel cladding liner material.

It is a further objective of the present invention to produce uniformly sized relatively small grain sizes in zirconium cladding liner materials containing less than 300 parts per million of iron impurities.

It is a further object of the present invention to provide a method for preventing the formation of bi-modal grain size distributions in unalloyed zirconium to be used as fuel cladding liner material.

It is a further object of the present invention to provide a coextruded nuclear fuel cladding comprising an outer zirconium alloy tube bonded to an inner relatively pure unalloyed zirconium liner which can be fabricated by conventional mill practices and continue to exhibit superior resistance to deleterious fuel pellet cladding interactions.

BRIEF SUMMARY OF THE INVENTION

Uniform small diameter grain sizes are achieved in relatively pure zirconium containing generally less than about 250 to 300 parts per million of Fe, or in amounts below its solubility limit in Zirconium, by the addition of small amounts of silicon to the zirconium compacts during electrode formation for subsequent vacuum arc melting to produce zirconium ingots. Preferably silicon is added in amounts of from about 40 parts per million to about 120 parts per million and most preferably in amounts of about 60 to about 90 parts per million to achieve the objects and advantages described herein.

DETAILED DESCRIPTION OF THE INVENTION

Figure 1:
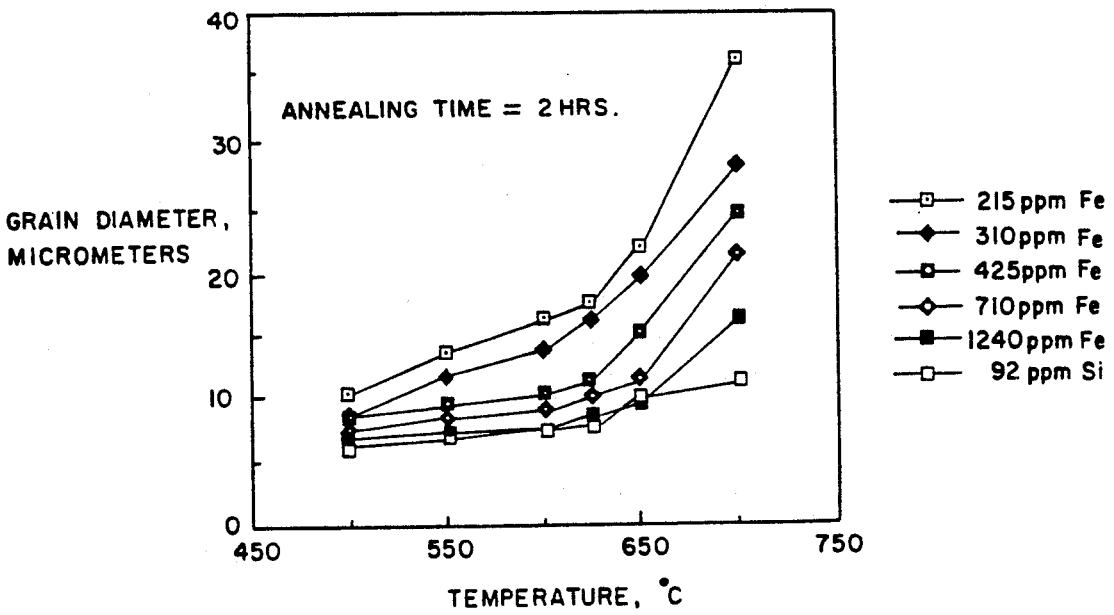
FIG. 1 is a graph of average grain diameter vs. annealing temperature at constant time from a range of iron and silicon in unalloyed zirconium.

Silicon is known to be a potent grain refiner for a variety of metals including iron, titanium and aluminum as well as zirconium. The atomistic nature of grain refinement in zirconium is believed to occur because silicon combines with zirconium to form a tetragonal crystal structure, $Zr_3Si$. Precipitation of extremely fine (less than $10^{-6}$m) zirconium silicide ($Zr_3Si$) particles occurs during cooling from the beta or body centered cubic phase of zirconium. These fine $Zr_3Si$ precipitates serve to retard grain boundary movement. By doing this, grain growth is retarded and secondary recrystallization is prevented. The grains follow the classical log-normal size vs. frequency distribution when their boundaries have been pinned or locked into place by the $Zr^3Si$ precipitates. Because clusters of large and small grains are not adjacent to each other, the formation of large strains at grain boundaries during cold deformation does not occur. In the absence of these localized strains, the zirconium liner material deforms uniformly and without cracking at the grain in boundaries.

In the production of a barrier tube shell for nuclear reactor fuel cladding there is an external layer of zirconium alloy and an internal or barrier layer of unalloyed zirconium. In accordance with well conventional practice an ingot of zirconium alloy (typically Zircaloy 2) is press forged, rotary forged, machined into billets and beta quenched into water from about 1050°-1150° C. An ingot of unalloyed zirconium is produced by multiple vacuum arc melting and is press forged and rotary forged into logs. The logs are machined into billets with an internal hole bored down the central axis, the length of the billet. The zirconium billets are extruded in the alpha temperature range into tubes. The extruded zirconium tube is cut to length and machined to fit a central hole bored through the Zircaloy billet. The liner tube and Zircaloy billet are cleaned, assembled an welded together. The assembled billet and liner tube are heated into the alpha range (600° C. to 700° C.) and coextruded into a barrier tubeshell. During coextrusion the barrier layer becomes intimately bonded to the Zircaloy substrate. The coextruded tubeshells are then annealed in the alpha range and can then be subjected to a series of cold reduction steps alpha annealing treatments, typically using a Pilger mill. Thus, the final size fuel cladding is achieved.

The addition of small quantities of silicon in the range of 40-120 ppm (and preferably between about 60 to about 90 ppm) is readily accomplished during ingot electrode makeup. Homogeneity of the silicon within the finished ingot is assured by multiple vacuum arc melting.

Uniform fine grain size is achieved by multiple cold reductions followed by recrystallization anneals. Annealing is limited to a temperature of less than 700° C. for 2 hrs. and preferably in the range of from 620° C. to 675° C. to less than 650° C. for 1 hr. The grain size of coextruded zirconium liner thus treated has an ASTM grain size of 9.5 to 11.

Advantages of the current invention include achieving a uniform fine grain size while controlling overall level of impurities (especially iron) to a much lower level than previously employed or than required by some proposed practices described in German Patent Application DE 3609074A1 filed Mar. 18, 1986 by Daniel Charquet and Marc Perez. Additionally, no further special heat treatments or quenching operations are required to ensure the effectiveness of the silicon addition. Because no additional process steps are required, the manufacturing costs are not increased over conventional practice.

A number of experiments were conducted to evaluate the effectiveness of silicon for the current application. The first series of experiments consisted of arc melting 250 gram buttons of pure zirconium with intentional additions of iron and silicon to compare the effectiveness of silicon vs. iron. The iron levels varied from 215 ppm to 1240 ppm. Silicon was added at the 90 ppm level to a low iron (245 ppm Fe) button. The buttons were remelted into small rectangular ingots which were then hot rolled to an intermediate thickness of 0.2". The hotband thus produced was vacuum annealed at 625° C. for 2 hrs. The annealed hotband was cold rolled to 0.1" thick and again vacuum annealed at 625° C. for 2 hrs. The strip was further cold rolled to 0.040" thick. Vacuum or air final anneals were performed over the ranges of 500° C. to 700° C. and 0.1 hr to 10 hrs. All specimens were metallographically prepared and photomicrographs were obtained. From the photomicrographs, a line intercept counting technique was used to determine average grain diameter in micrometers. FIG. 1 displays a plot of average grain diameter vs. annealing temperature (annealing time 2 hrs.) for the range of iron and silicon compositions mentioned above. One can see that in the non-quenched condition, the sample containing 92 ppm Si and 245 ppm Fe has a smaller grain size than does the sample with the highest iron level of 1240 ppm.

Figure 2:
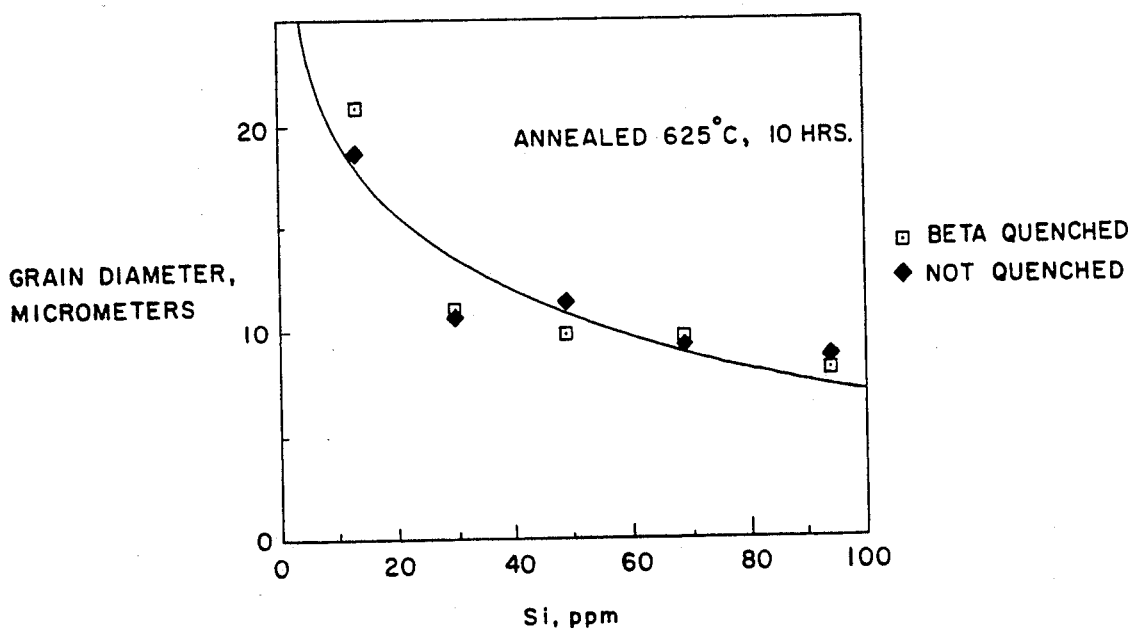
FIG. 2 is a graph of average grain diameter for different concentrations of Silicon in zirconium for unquenched billets and beta quenched billets.

A second experiment was conducted to investigate the effect of varying levels of silicon on grain size. A number of buttons were melted to give a range of silicon from 12 ppm to 94 ppm. The buttons were drop cast into rectangular ingots, hot rolled, annealed, cold rolled and final annealed at 625° C. for 0.1-10 hrs., as in the first experiment. The average grain diameter for a 625° C.-10 hr. final anneal was obtained and is shown in FIG. 2 plotted against the silicon content. Additionally, at the 0.2" thickness the hotband was split into two equal quantities and one half was beta quenched while the other half was not. Based on FIG. 2, the optimum level of silicon is greater than 40 ppm and less than 100 ppm with most grain refinement occurring by about 60 ppm. Beta quenching of zirconium containing less than 300ppm iron was found to have no effect on the efficacy of the silicon's grain refining ability.

A third experiment was conducted, whereby the laboratory experiments were scaled up into a production sized environment. A 14" diameter pure Zr liner ingot was produced to the chemistry shown in Table 1. Notice that the silicon addition is aimed at 60 ppm and iron is intentionally kept at about 300 ppm or below. Preferably the iron-silicon was added as ferrosilicon. The ingot was forged to 7½" diameter and sawed into extrusion billet lengths. One billet was beta solution treated (900-950° C. for 3-4 minutes) and water quenched. A second billet did not receive this treatment. Both billets were extruded in the alpha phase at 700° C. maximum furnace set temperature. Zircaloy 2 billets were prepared by forging, machining, induction beta quenched and final machined to receive the finished liners according to current state-of-the-art.

The two coextrusion billets were assembled, welded, coextruded to 2.5" OD×0.44" wall tubeshells. The tubeshells were vacuum annealed at 620° C. for 60 minutes. Liner samples were obtained from the lead and tail ends of the coextruded tubeshell. The grain size was measured and is shown in Table II.

Thus, barrier tubeshell made in accordance with standard production procedures and incorporating 60 ppm silicon shows a fine uniform grain size of 8.2 micrometers or less. Measurements made on liner grain size from production material without silicon additions shows an average grain size of 16 micrometers. Moreover, the silicon bearing liner microstructure shows no evidence of secondary recrystallization as evidenced by a duplex grain size distribution.

TABLE 1

Heat 355838 Ingot Chemistry
Zr Liner Ingot 13.7"ϕ × 21.8" L × 730 lbs.

| | | | |
|---|---|---|---|
| Al | <20 | <20 | <20 |
| B | <.25 | <.25 | <.25 |
| C | 50 | 50 | 50 |
| Ca | <10 | <10 | <10 |
| Cd | <.25 | <.25 | <.25 |
| Cl | <5 | <5 | <5 |
| Co | <10 | <10 | <10 |
| Cr | <50 | <50 | <50 |
| Cu | <10 | <10 | <10 |
| Fe | 310 | 285 | 300 |
| H | <5 | <5 | <5 |
| Hf | 57 | 59 | 54 |

TABLE 1-continued

| Heat 355838 Ingot Chemistry Zr Liner Ingot 13.7"ϕ × 21.8" L × 730 lbs. | | | |
|---|---|---|---|
| Mg | <10 | <10 | <10 |
| Mn | <25 | <25 | <25 |
| Mo | <10 | <10 | <10 |
| N | 42 | 23 | 27 |
| Na | <5 | <5 | <5 |
| Nb | <50 | <50 | <50 |
| Ni | <35 | <35 | <35 |
| O | 500 | 490 | 460 |
| P | 7 | 6 | 6 |
| Pb | <25 | <25 | <25 |
| Si | 62 | 57 | 61 |
| Sn | <10 | <10 | <10 |
| Ta | <50 | <50 | <50 |
| Ti | <25 | <25 | <25 |
| U | <1.0 | <1.0 | <1.0 |
| V | <25 | <25 | <25 |
| W | <25 | <25 | <25 |

TABLE II

| | Lead End | Trail End |
|---|---|---|
| Beta Quenched | 10 ½ (8.2 μm) | 11 ½ (5.8 μm) |
| Non-quenched | 10 ½ (8.2 μm) | 11 (6.9 μm) |

The nature of this invention is such that it would be applicable to other zirconium or zirconium alloy product forms. Specifically, commercially pure zirconium, referred to as UNS Grade R60702, would benefit from the grain refining effects of silicon at the upper levels (100–120 ppm) of the current invention. The finer grained, more homogeneous product thus produced would lend itself to improving formability, specifically of sheet parts.

The invention has been described by reference to the present preferred embodiments thereof. Variations in compositions and processing conditions may be employed within the spirit and scope of the inventive concepts described herein. The invention should, therefore, only be limited by the scope of the appended claims interpreted in light of the pertinent prior art.

I claim:

1. A method of making a bonded two shell component cladding element for containing nuclear fuel wherein an outer shell of said element consists essentially of a zirconium alloy and an inner tube shell of said element comprises unalloyed silicon grain-refined zirconium extruded together with said outer alloy shell forming a unitary article, comprising the steps of:

forming an outer tube billet of zirconium alloy of preselected dimensions; heating said alloy to a temperature in the beta-phase at about 1050° C. to about 1150° C. and water quenching said alloy before extrusion in the alpha phase, forming a liner tube of unalloyed zirconium of preselected dimensions obtained by extrusion to a temperature in the alpha phase at about 600° C to about 700° C., said preselected dimensions being such that said unalloyed zirconium tube fits snugly inside of said zirconium alloy tube forming an interface therebetween, coextruding said tube and said billet to form a unitary cladding tube, then annealing said formed tube under vacuum at a temperature of from about 600° C. to about 700° C. to recrystallize said zirconium and zirconium alloy for further cold working conditions, said unalloyed zirconium liner of coextruded unitary cladding tube characterized by containing between about 40 ppm and about 120 ppm silicon and containing less Fe than its solubility limit in zirconium and exhibiting fine uniform average grain size of less than about ASTM 11 distributed substantially uniformly and further characterized in that stress corrosion cracking is minimized.

2. The method of claim 1 wherein the inner tube liner of unalloyed zirconium produced thereby comprises the following impurities in said zirconium as parts per million as follows:

Al, less than about 20
B, less than about 0.25
C about 50
Ca less than about 10
Cd less than about 0.25
Cl less than about 5
Co less than about 10
Cr less than about 50
Cu less than about 10
Fe less than about 300
H less than about 5
Hf less than about 59
Mg less than about 10
Mn less than about 25
Mo less than about 10
N less than about 42
Na less than about 5
Nb less than about 50
Ni less than about 35
O less than about 500
P less than about 7
Pb less than about 25
Si less than about 62
Sr less than about 10
Ta less than about 50
Ti less than about 25
U less than about 1.0
V less than about 25
W less than about 25.

* * * * *